US010895087B1

(12) United States Patent
Mou et al.

(10) Patent No.: US 10,895,087 B1
(45) Date of Patent: Jan. 19, 2021

(54) FABRICATED SELF-RESILIENT ENERGY-DISSIPATION DOUBLE-STEEL-PLATE SLOTTED SHEAR WALL STRUCTURE

(71) Applicant: Qingdao University of Technology, Qingdao (CN)

(72) Inventors: Ben Mou, Qingdao (CN); Xi Li, Qingdao (CN); Jijun Miao, Qingdao (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 16/624,910

(22) PCT Filed: Jul. 5, 2018

(86) PCT No.: PCT/CN2018/094607

§ 371 (c)(1),
(2) Date: Dec. 20, 2019

(87) PCT Pub. No.: WO2019/200727

PCT Pub. Date: Oct. 24, 2019

(30) Foreign Application Priority Data

Apr. 20, 2018 (CN) ..... 2018 1 0358746

(51) Int. Cl.
*E04H 9/02* (2006.01)
*E04B 1/24* (2006.01)

(52) U.S. Cl.
CPC ..... *E04H 9/024* (2013.01); *E04B 2001/2415* (2013.01); *E04B 2001/2418* (2013.01);
(Continued)

(58) Field of Classification Search
CPC ..... E04H 9/024; E04B 2001/2415; E04B 2001/2418; E04B 2001/2451
(Continued)

(56) References Cited

U.S. PATENT DOCUMENTS 5,279,088 A * 1/1994 Heydon ..... E04B 1/0007 52/223.6
2014/0059950 A1* 3/2014 Marinovic ..... E04H 9/021 52/167.3
(Continued)

FOREIGN PATENT DOCUMENTS

CN 101126253 A 2/2008
CN 104912226 A 9/2015
(Continued)

*Primary Examiner* — Paola Agudelo
(74) *Attorney, Agent, or Firm* — Bayramoglu Law Offices LLC

(57) ABSTRACT

A fabricated self-resilient energy-dissipation double-steel-plate slotted shear wall structure includes steel columns, H-shaped steel beams and a shear wall assembly. The shear wall assembly includes left and right groups of slotted wall plates and is connected with flanges of the H-shaped steel beams through angle steel. Connecting ring plate assemblies are fixed to upper and lower ends of each steel column and each comprise an outer ring plate, an inner ring plate and a short side plate. A long side plate is fixedly arranged on each steel column tube and is connected with one slotted wall plate through a plurality of self-locking hasps. A plurality of pre-stressed steel strands are arranged on two sides of each long side plate.

16 Claims, 6 Drawing Sheets

(52) U.S. Cl.
CPC ..... *E04B 2001/2451* (2013.01); *E04B 2001/2466* (2013.01); *E04B 2001/2481* (2013.01); *E04B 2001/2496* (2013.01)

(58) Field of Classification Search
USPC ..... 52/167.1
See application file for complete search history.

(56) References Cited

U.S. PATENT DOCUMENTS

| | | | | |
|---|---|---|---|---|
| 2015/0204097 | A1* | 7/2015 | Chou | E04G 23/0218 52/167.1 |
| 2015/0361657 | A1* | 12/2015 | Hejazi | E04H 9/027 52/167.2 |
| 2017/0058514 | A1* | 3/2017 | Wu | E04H 9/021 |
| 2018/0187407 | A1* | 7/2018 | Mou | E04B 1/2403 |
| 2018/0238042 | A1* | 8/2018 | Collins | E04B 1/2403 |
| 2018/0245340 | A1* | 8/2018 | Viskovic | E04H 9/025 |
| 2018/0347222 | A1* | 12/2018 | Richards | E04H 9/021 |
| 2019/0100935 | A1* | 4/2019 | Staszczyk | G06F 30/13 |

FOREIGN PATENT DOCUMENTS

| | | | |
|---|---|---|---|
| CN | 204983239 | U | 1/2016 |
| CN | 106088334 | A | 11/2016 |
| JP | 2006045776 | A | 2/2006 |
| KR | 20130139627 | A | 12/2013 |

* cited by examiner

FABRICATED SELF-RESILIENT ENERGY-DISSIPATION DOUBLE-STEEL-PLATE SLOTTED SHEAR WALL STRUCTURE

CROSS REFERENCE TO THE RELATED APPLICATIONS

This application is the national phase entry of International Application No. PCT/CN2018/094607, filed on Jul. 5, 2018, which is based upon and claims priority to Chinese Patent Application No. 201810358746.8, filed on Apr. 20, 2018, the entire contents of which are incorporated herein by reference.

TECHNICAL FIELD

The invention relates to the technical field of connection of building structures, in particular to a fabricated self-resilient energy-dissipation double-steel-plate slotted shear wall structure.

BACKGROUND

Nowadays, more and more high-rise buildings and super high-rise buildings have been constructed in cities. With the constant increase of the building height, the control effect of horizontal loads is becoming more and more prominent compared with vertical loads, and the selection of lateral-force-resisting components is of great importance.

As walls typically bearing horizontal shear force, steel plate shear wall assemblies have a force-bearing unit consisting of embedded steel plates, vertical edge members (columns or vertical stiffening ribs), and horizontal edge members (beams or horizontal stiffening ribs). As novel lateral-force-resisting components, the steel plate shear wall assemblies have the advantages of large initial elastic stiffness, high deformability, good plasticity and stable hysteresis, thereby being widely applied to lateral-force-resisting structure systems.

The steel plate shear wall assemblies are novel anti-seismic components which are designed in a manner that a series of vertical slots are formed in the steel plates and a series of small curved columns are formed by wall limbs between the vertical slots of a steel plate wall to fulfill good ductility.

Due to the fact that existing steel plate shear wall assemblies have a low degree of assembly and are connected with beams and columns typically by full welding or by bolting and welding, brittle failures may be caused in an earthquake by poor quality of weld joints and lack of effective protection, and once the steel plate shear wall assemblies are destroyed, these assemblies are unlikely to be repaired, reinforced or replaced and cannot continue to work anymore, which will inevitably affect the reliability of the shear wall assemblies or lead to material waste.

Steel plate shear wall assemblies which are able to automatically resile after being deformed in an earthquake have nowadays become available by horizontal arrangement of pre-stressed steel strands, such as Patent Application No. 2015103100491. However, the steel plate shear wall assemblies designed in such manner have the problems of insufficient construction workface, difficult installation and low energy-dissipation degree. Fabricated replaceable steel plate shear wall assemblies have to be entirely replaced, thus resulting in steel waste.

SUMMARY

The primary objective of the invention is to solve the above-mentioned problems by providing a fabricated self-resilient energy-dissipation double-steel-plate slotted shear wall structure which realizes fully-fabricated construction, allows steel plate shear walls to be independently replaced, is easy to repair after an earthquake, and is able to resile automatically.

To fulfill the above objective, the fabricated self-resilient energy-dissipation double-steel-plate slotted shear wall structure of the invention comprises steel columns, H-shaped steel beams and a shear wall assembly, wherein the steel columns are arranged on left and right sides of the shear wall assembly, the H-shaped steel beams are arranged at upper and lower ends of the shear wall assembly, and the shear wall assembly comprises left and right groups of slotted wall plates which are connected in an overlap manner through connecting plates I; and the shear wall assembly is connected with flanges of the H-shaped steel beams through angle steel;

Connecting ring plate assemblies are fixed to upper and lower ends of each steel column; and each connecting ring plate assembly comprises an outer ring plate, an inner ring plate and a short side plate, wherein the short side plate is arranged between the outer ring plate and the inner ring plate and is fixedly connected with the outer ring plate, the inner ring plate and the steel column;

The outer ring plate is connected with the flange of one side of one H-shaped steel beam in an overlap manner through a connecting plate II, the inner ring plate is connected with the flange of the other side of the H-shaped steel beam in an overlap manner through a connecting plate III, and the short side plate is connected with a web of the H-shaped steel beam in an overlap manner through a connecting plate IV;

A long side plate is fixedly arranged on a steel column tube between the upper and lower connecting ring plate assemblies and is connected with one slotted wall plate through a plurality of self-locking hasps; each self-locking hasp comprises a hasp base to be arranged on the long side plate and a hasp member to be arranged on the slotted wall plate, wherein the hasp member comprises a connecting arm and a hasp, the width of the hasp is greater than that of the connecting arm, and the hasp base is provided with a hasp slot matched with the hasp and a groove matched with the connecting arm; and A plurality of pre-stressed steel strands are arranged on two sides of the long side plate, and each of the two ends of each pre-stressed steel strand penetrates through the inner ring plate, the flange of one side of the H-shaped steel beam and the connecting plate III to be anchored to the connecting plate III.

Furthermore, each group of slotted wall plates of the shear wall assembly includes at least two slotted wall plates, and the slotted wall plates are standard components prefabricated in a factory, are of different models, and are assembled.

Furthermore, each slotted wall plate has a plurality of S-shaped streamline slots.

Furthermore, both ends of each streamline slot adopt circular arc transition to reduce stress concentration.

Furthermore, the number of the connecting plates I are two, and the two connecting plates I are symmetrically arranged on front and back sides of the shear wall assembly.

Furthermore, each H-shaped steel beam is connected with the shear wall assembly through two pieces of angle steel which are symmetrically arranged on front and back sides of the shear wall assembly.

Furthermore, the slotted wall plates are connected with the connecting plates I through high-strength bolts, the outer ring plates are connected with the connecting plates II through high-strength bolts, the inner ring plates are connected with the connecting plates III through high-strength bolts, the short side plates are connected with the connecting plates IV through high-strength bolts, the shear wall assembly is connected with the angle steel through high-strength bolts, and the flanges of the H-shaped steel beams are connected with the angle steel through high-strength bolts.

Furthermore, the high-strength bolts is able to withstand a high pressure, and have a strength grade of 10.9 and a specification of M16-M30.

An assembly method of the fabricated self-resilient energy-dissipation double-steel-plate slotted shear wall structure comprises the following steps:

Step 1: connecting the steel columns and the steel beams which are prefabricated in a factory, and tensioning and anchoring the pre-stressed steel strands to form a beam-column frame;

Step 2: inserting the hasp members of the two bottom slotted wall plates of the shear wall assembly into the corresponding hasp bases, then horizontally rotating the slotted wall plates inwards to self-lock and fasten the slotted wall plates, sequentially assembling, from bottom to top, the remaining slotted wall plates, and self-locking and fastening the remaining slotted wall plates;

Step 3: assembling the connecting plates I on the front and back sides of the shear wall assembly in a manner that the connecting plates 1 are connected with the slotted wall plates on the left and right sides in an overlap manner, and then fastening the connecting plates I with high-strength bolts; and Step 4: assembling the angle steel on front and back sides of a junction between the shear wall assembly and the upper H-shaped steel beam as well as front and back sides of a junction between the shear wall assembly and the lower H-shaped steel beam, and connecting the shear wall assembly with the H-shaped steel beams through high-strength bolts.

The invention has the following beneficial effects:

(1) All components of the invention can be machined in a factory, all field connections are completed with bolts, fully-fabricated construction of steel plate shear walls is realized, possible quality problems caused by field welding are avoided, the construction progress is accelerated, and efficiency is improved;

(2) A whole shear wall can dissipate energy first in an earthquake through the multiple S-shaped streamline slots formed in the steel plate shear wall assembly of the invention, so that plastic deformation is controlled within the steel plate shear wall assembly; the pre-stressed steel strands used for self-resilience are arranged at the ends of the columns, so that the energy-dissipation degree is high; and the structure is able to resile automatically through the pre-stressed steel strands after a major earthquake, so that the main structure is kept in an elastic state all the time, and the seismic fortification objective of preventing collapses under strong earthquakes is fulfilled; and (3) The shear wall assembly of the invention consists of a plurality of slotted wall plates, so that only damaged parts instead of the whole structure need to be replaced after an earthquake, the seismic fortification objective of maintenance after medium earthquakes is fulfilled, the maintenance time is shortened, the maintenance cost is reduced, and costs are reduced.

Reference Signs: 1, steel column; 2, H-shaped steel beam; 3, slotted wall plate; 4, connecting plate I; 5, angle steel; 6, outer ring plate; 7, inner ring plate; 8, short side plate; 9, long side plate; 10, connecting plate II; 11, connecting plate III; 12, connecting plate IV; 13, self-locking hasp; 14, connecting arm; 15, hasp; 16, hasp slot; 17, groove; 18, pre-stressed steel strand.

DETAILED DESCRIPTION OF THE EMBODIMENTS

The invention is further described below in combination with the accompanying drawings.

Figure 1:
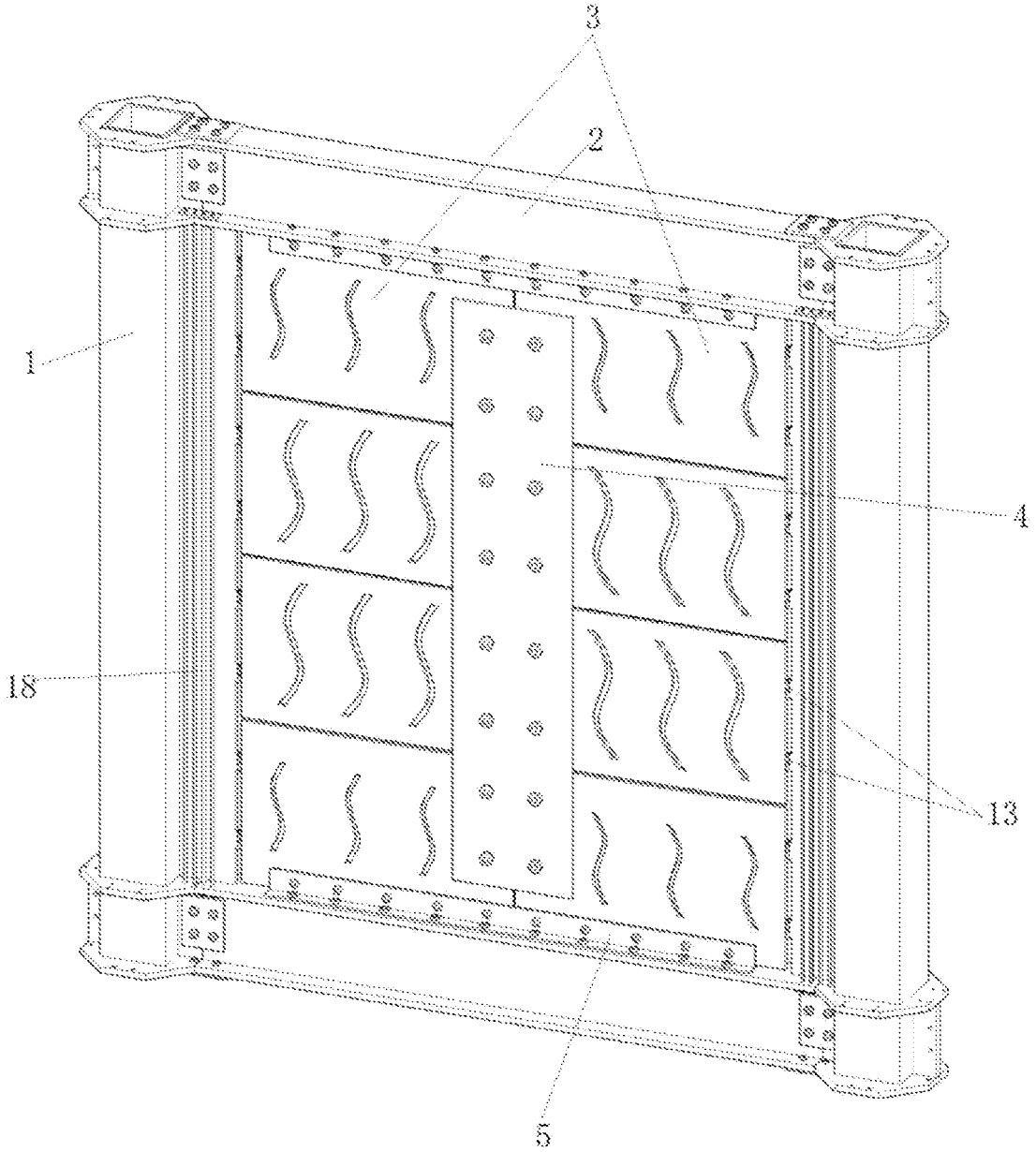
FIG. 1 is a structural view of the invention.

As shown in FIG. 1, the fabricated self-resilient energy-dissipation double-steel-plate slotted shear wall structure of the invention comprises steel columns 1, H-shaped steel beams 2 and a shear wall assembly, wherein the steel columns are arranged on left and right sides of the shear wall assembly, and the H-shaped steel beams are arranged at upper and lower ends of the shear wall assembly.

The shear wall assembly comprises left and right groups of slotted wall plates. Each group of slotted wall plates includes at least two slotted wall plates 3. As shown in FIG. 1, each group of slotted wall plates includes four slotted wall plates. Each slotted wall plate has a plurality of S-shaped streamline slots. Both ends of each streamline slot adopt circular arc transition to reduce stress concentration. The two groups of slotted wall plates are connected in an overlap manner through two connecting plates I 4 which are symmetrically arranged on front and back sides of the shear wall assembly. The shear wall assembly is connected with flanges of the H-shaped steel beams through two pieces of angle steel 5 which are symmetrically arranged on the front and back sides of the shear wall assembly, and each piece of angle steel has an edge connected with a flange plate of one H-shaped steel beam through a bolt and an edge connected with one slotted wall plate of the shear wall assembly through a bolt.

Figure 2:
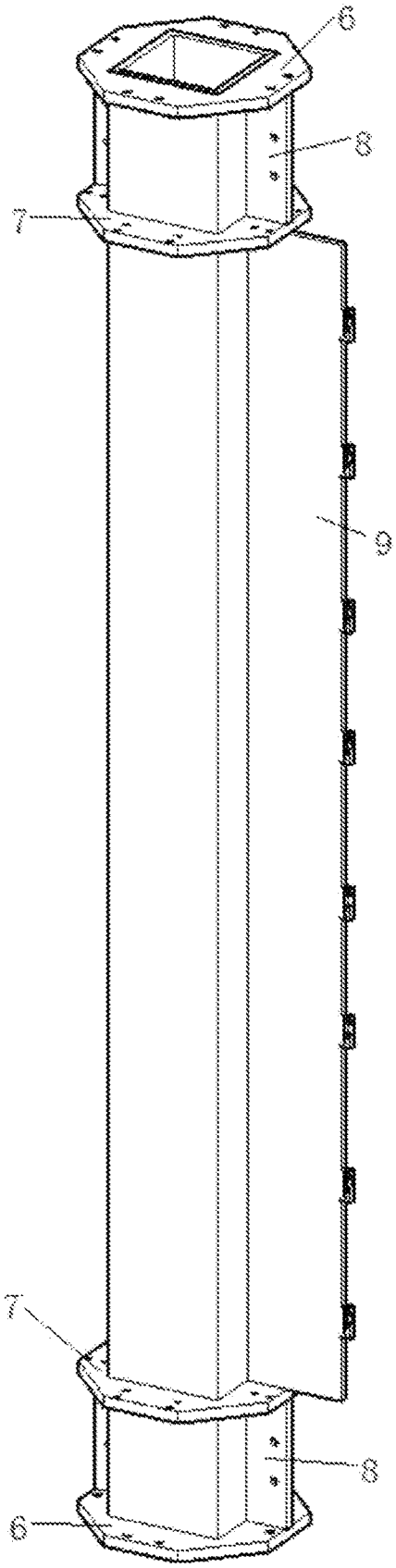
FIG. 2 is a structural view of a steel column.

As shown in FIG. 2, connecting ring plate assemblies are fixed to upper and lower ends of each steel column. Each connecting ring plate assembly comprises an outer ring plate 6, an inner ring plate 7 and a short side plate 8, wherein the short side plate is arranged between the outer ring plate and the inner ring plate and is fixedly connected with the outer ring plate, the inner ring plate and the steel column. A long side plate 9 is fixedly arranged on a steel column tube between the upper and lower connecting ring plate assemblies of each steel column.

Figure 3:
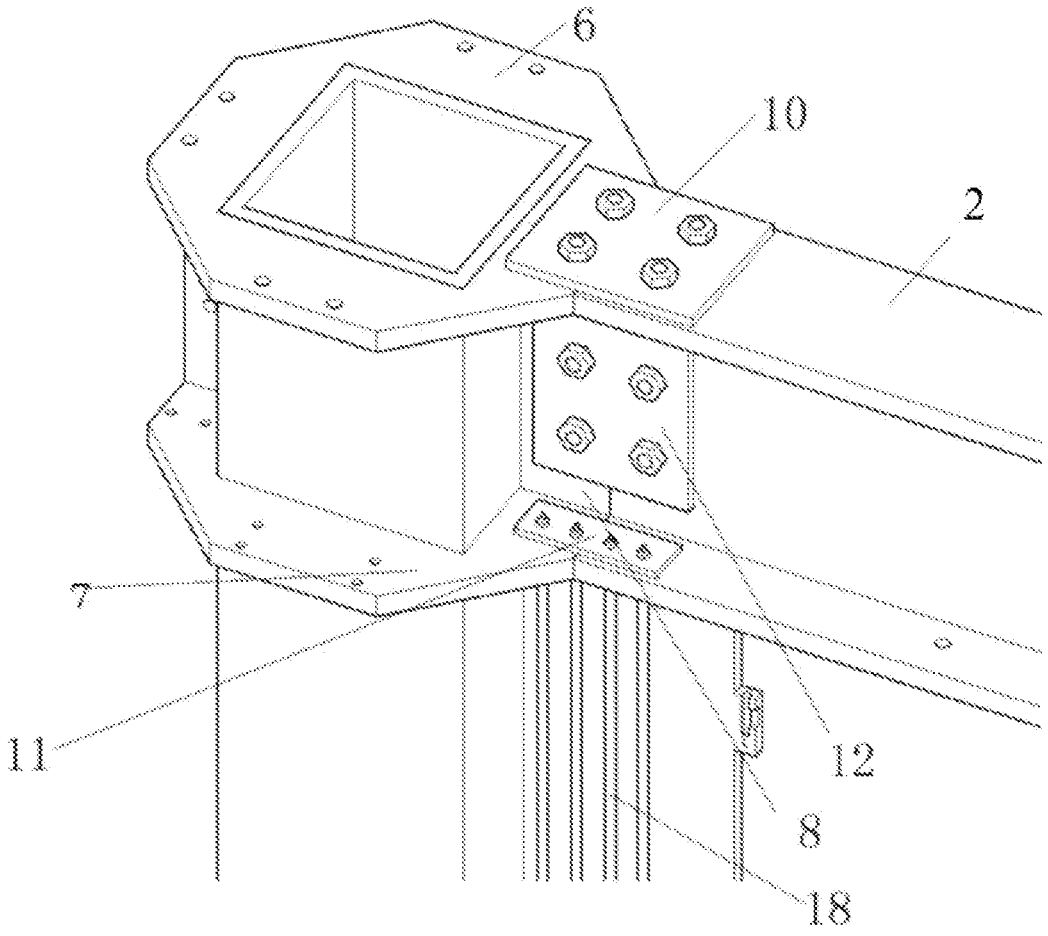
FIG. 3 is a connection structural view of the steel column and an H-shaped steel beam.
Figure 4:
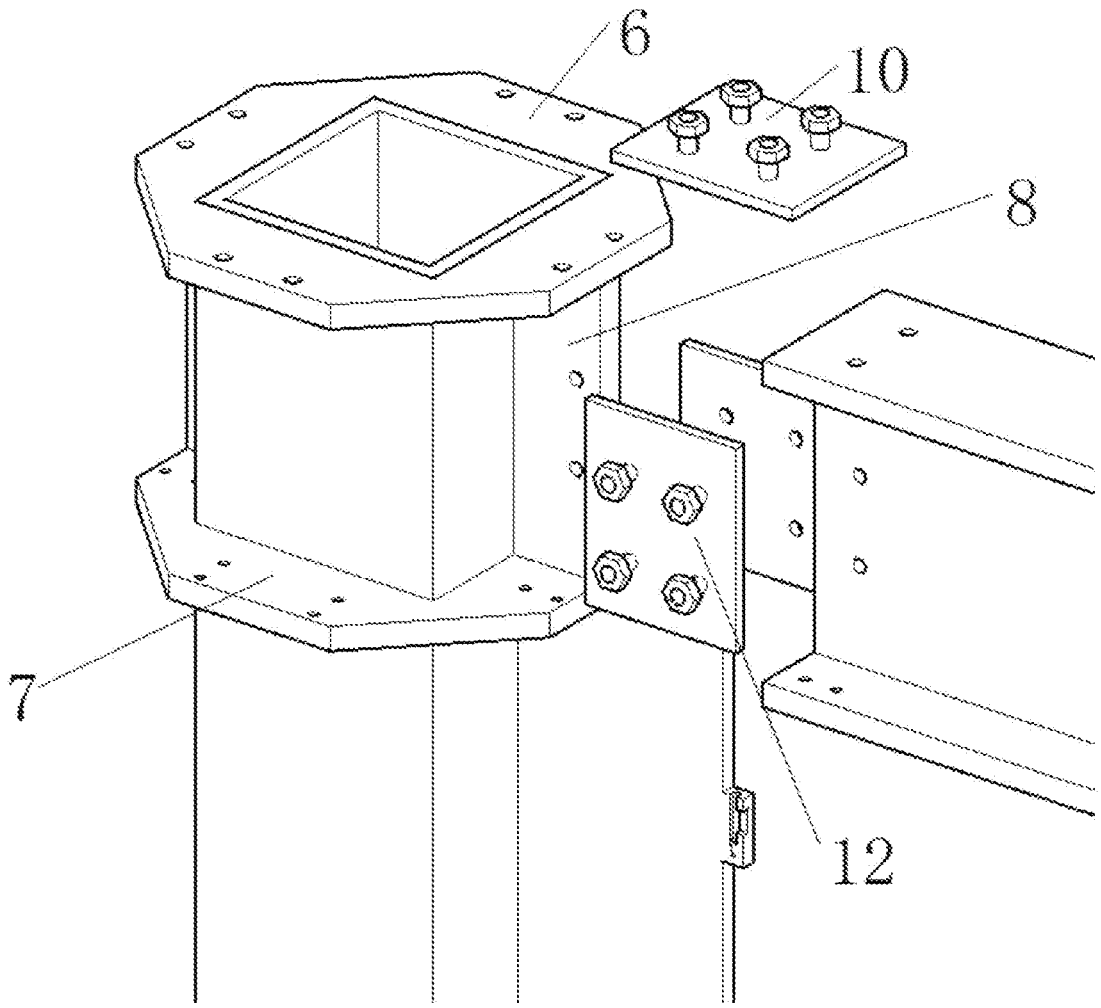
FIG. 4 is an exploded view of FIG. 3.
Figure 5:
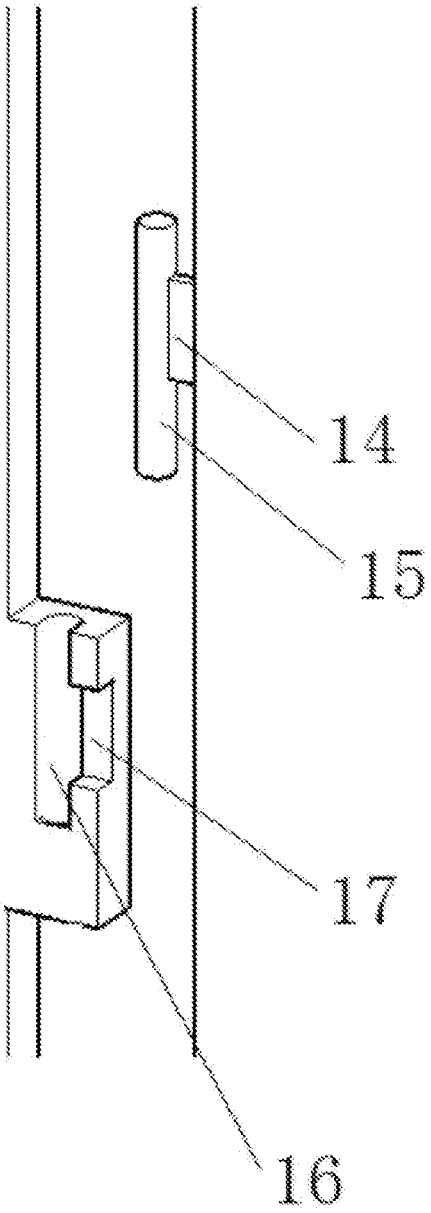
FIG. 5 is a disassembled structural view of a self-locking hasp.

As shown in FIG. 3 and FIG. 4, the outer ring plate is connected with the flange of one side of one H-shaped steel beam in an overlap manner through a connecting plate II 10, the inner ring plate is connected with the flange of the other side of the H-shaped steel beam in an overlap manner through a connecting plate III 11, and the short side plate is connected with a web of the H-shaped steel beam in an overlap manner through two connecting plates IV 12 which are arranged on two sides of the web of the H-shaped steel beam;

As shown in FIG. 1, the long side plates are connected with the slotted wall plates of the shear wall assembly through a plurality of self-locking hasps 13. As shown in FIG. 5, each self-locking hasp comprises a hasp base to be arranged on one long side plate and a hasp member to be arranged on one slotted wall plate of the shear wall assembly, wherein the hasp member comprises a cylindrical connecting arm 14 and a rectangular hasp 15, the diameter of the hasp is greater than the width of the connecting arm, and the hasp base is provided with a hasp slot 16 matched with the hasp and a groove 17 matched with the connecting arm.

As shown in FIG. 1 and FIG. 3, a plurality of pre-stressed steel strands 18 are arranged on two sides of each long side plate, each of the two ends of each pre-stressed steel strand 18 penetrates through one inner ring plate, the flange of one side of one H-shaped steel beam, and one connecting plate III to be anchored on one connecting plate III, and the ultimate bearing capacity of the pre-stressed steel strands 18 is 30%-50%.

All connections mentioned above, including the connection between the slotted wall plates and the connecting plates I, the connection between the outer ring plates and the connecting plates II, the connection between the inner ring plates and the connecting plates III, the connection between the short side plates and the connecting plates IV, the connection between the slotted wall plates and the angle steel, and the connection between the flanges of the H-shaped steel beams and the angle steel, are realized through high-strength bolts, wherein the high-strength bolts are able to withstand a high pressure, and have a strength grade of 10.9 and a specification of M16-M30.

Figure 6:
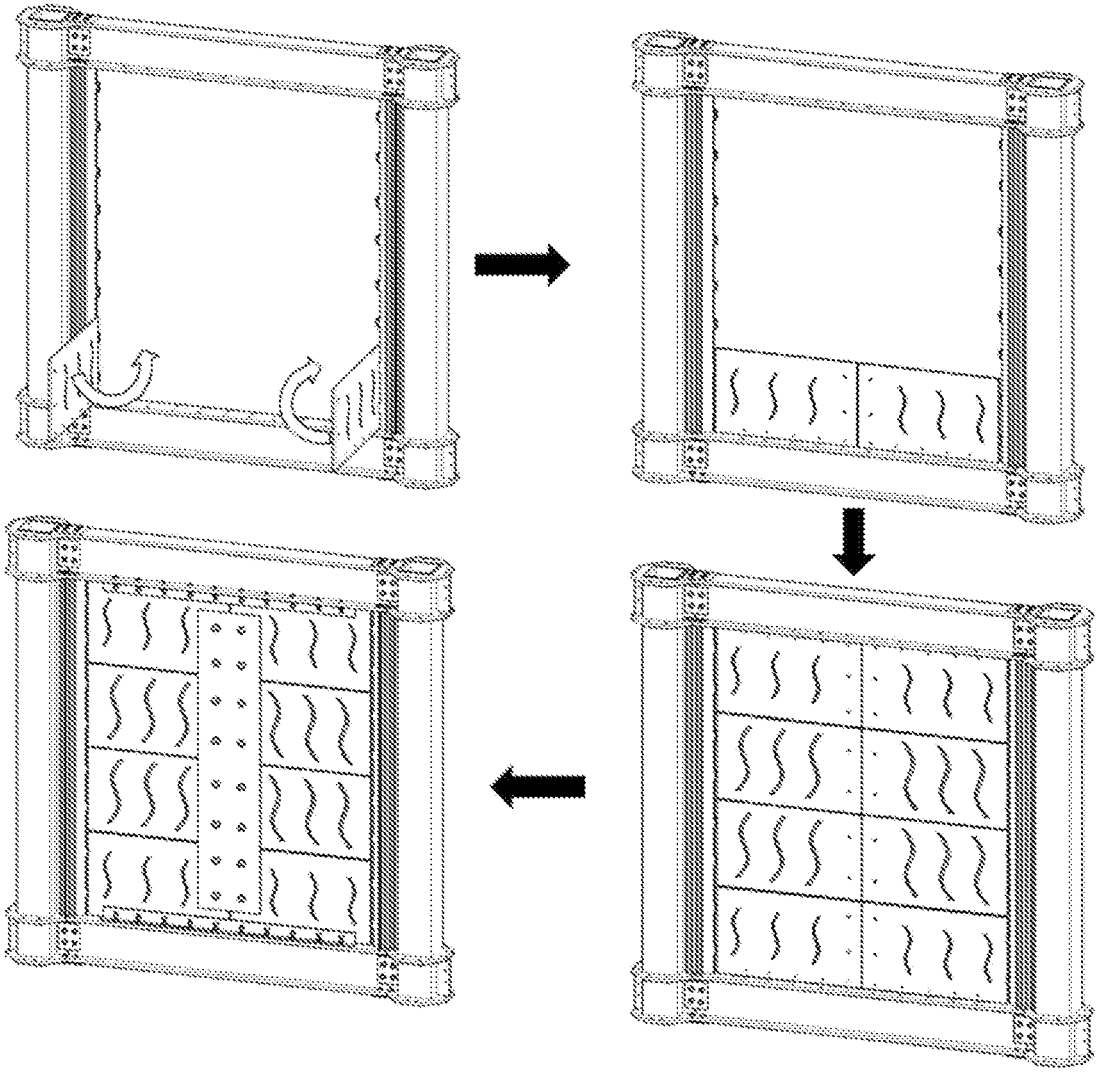
FIG. 6 is an assembly schematic diagram of the invention.

As shown in FIG. 6, an assembly method of the fabricated self-resilient energy-dissipation double-steel-plate slotted shear wall structure comprises the following steps:

Step 1: the steel columns and the steel beams which are prefabricated in a factory are connected, and the pre-stressed steel strands are tensioned and anchored to form a beam-column frame;

Step 2: the hasp members of the two bottom slotted wall plates of the shear wall assembly are inserted into the corresponding hasp bases, then the slotted wall plates are horizontally rotated inwards to be self-locked and fastened, and the remaining slotted wall plates are sequentially assembled from bottom to top and are then self-locked and fastened;

Step 3: the connecting plates I are assembled on the front and back sides of the shear wall assembly in a manner that the connecting plates 1 are connected with the slotted wall plates on the left and right sides in an overlap manner, and then the connecting plates I are fastened with high-strength bolts; and Step 4: the angle steel is assembled on front and back sides of a junction between the shear wall assembly and the upper H-shaped steel beam as well as front and back sides of a junction between the shear wall assembly and the lower H-shaped steel beam, and the shear wall assembly and the H-shaped steel beams are connected through high-strength bolts.

The above embodiments are only preferred ones of the invention, and are not intended to limit the invention. Various modifications and transformations can be made by those skilled in the art. Any modifications, equivalent substitutions and improvements obtained without deviating from the spirit and principle of the invention should also fall within the protection scope of the invention.

What is claimed is:

1. A fabricated self-resilient energy-dissipation double-steel-plate slotted shear wall structure, comprising:

steel columns,

H-shaped steel beams, and a shear wall assembly;

wherein the steel columns are arranged on a left side and a right side of the shear wall assembly, and the H-shaped steel beams are arranged at an upper end and a lower end of the shear wall assembly;

the shear wall assembly comprises a left group of slotted wall plates and a right group of slotted wall plates, wherein the left group of slotted wall plates and the right group of slotted wall plates are connected in an overlap manner through a plurality of first connecting plates; the shear wall assembly is connected with a first flange of each H-shaped steel beam of the H-shaped steel beams through an angle steel;

connecting ring plate assemblies are fixed to an upper end of each steel column of the steel columns and a lower end of the each steel column; and each of the connecting ring plate assemblies comprises an outer ring plate, an inner ring plate and a short side plate, wherein the short side plate is arranged between the outer ring plate and the inner ring plate, and the short side plate is fixedly connected with the outer ring plate, the inner ring plate and the each steel column;

the outer ring plate is connected with a second flange of a first side of the each H-shaped steel beam in the overlap manner through a second connecting plate, the inner ring plate is connected with the first flange of a second side of the each H-shaped steel beam in the overlap manner through a third connecting plate, and the short side plate is connected with a web of the H-shaped steel beam in the overlap manner through a fourth connecting plate;

a long side plate is fixedly arranged on each of the steel columns between the connecting ring plate assemblies, and the long side plate is connected with the left group of slotted wall plates or the right group of slotted wall plates through a plurality of self-locking hasps; each of the plurality of self-locking hasps comprises a hasp base and a hasp member, wherein the hasp base is arranged on the long side plate, and the hasp member is arranged on the slotted wall plate, the hasp member comprises a connecting arm and a hasp, the hasp is a circular cylinder, a diameter of the hasp is greater than a width of the connecting arm, and the hasp base is provided with a hasp slot matched with the hasp and a groove matched with the connecting arm; and a plurality of pre-stressed steel strands are arranged on two sides of the long side plate, and each of two ends of each of the plurality of pre-stressed steel strands penetrates through the inner ring plate, the first flange of the second side of the H-shaped steel beam and the third connecting plate to be anchored to the third connecting plate.

2. The fabricated self-resilient energy-dissipation double-steel-plate slotted shear wall structure according to claim 1, wherein, the left group of slotted wall plates or the right group of slotted wall plates of the shear wall assembly comprises at least two slotted wall plates.

3. The fabricated self-resilient energy-dissipation double-steel-plate slotted shear wall structure according to claim 1, wherein, each of the left group of slotted wall plates and the right group of slotted wall plates comprises a plurality of S-shaped streamline slots.

4. The fabricated self-resilient energy-dissipation double-steel-plate slotted shear wall structure according to claim 3, wherein, both ends of each of the plurality of S-shaped streamline slots respectively comprise a circular arc transition to reduce a stress concentration.

5. The fabricated self-resilient energy-dissipation double-steel-plate slotted shear wall structure according to claim 1, wherein a number of the plurality of first connecting plates is two, and the two first connecting plates are symmetrically arranged on a front side and a back side of the shear wall assembly.

6. The fabricated self-resilient energy-dissipation double-steel-plate slotted shear wall structure according to claim 1, wherein, each of the H-shaped steel beams is connected with the shear wall assembly through two pieces of the angle steel, wherein the two pieces of the angle steel are symmetrically arranged on a front side and a back side of the shear wall assembly.

7. The fabricated self-resilient energy-dissipation double-steel-plate slotted shear wall structure according to claim 1, wherein, the left group of slotted wall plates and the right group of slotted wall plates are connected with the plurality of first connecting plates through a first plurality of high-strength bolts, the outer ring plate is connected with the second connecting plate through a second plurality of high-strength bolts, the inner ring plate is connected with the third connecting plate through a third plurality of high-strength bolts, the short side plate is connected with the fourth connecting plate through a fourth plurality of high-strength bolts, the shear wall assembly is connected with the angle steel through a fifth plurality of high-strength bolts, and the first flange of the each H-shaped steel beam is connected with the angle steel through a sixth plurality of high-strength bolts.

8. The fabricated self-resilient energy-dissipation double-steel-plate slotted shear wall structure according to claim 7, wherein, each high-strength bolt of the first plurality of high-strength bolts, the second plurality of high-strength bolts, the third plurality of high-strength bolts, the fourth plurality of high-strength bolts, the fifth plurality of high-strength bolts and the sixth plurality of high-strength bolts is configured to withstand a high pressure, and the each high-strength bolt has a strength grade of 10.9 and a specification of M16-M30.

9. An assembly method of the fabricated self-resilient energy-dissipation double-steel-plate slotted shear wall structure according to claim 1, comprising the following steps:

step 1: connecting the steel columns and the H-shaped steel beams, wherein the steel columns and the H-shaped steel beams are prefabricated in a factory, and tensioning and anchoring the plurality of pre-stressed steel strands to form a beam-column frame;

step 2: inserting hasp members of two bottom slotted wall plates of the shear wall assembly into the hasp base, then horizontally rotating the two bottom slotted wall plates inwards to be self-lock and fasten,sequentially assembling, from bottom to top, the remaining slotted wall plates for self-locking and fastening;

step 3: assembling the plurality of first connecting plates on a front side and a back side of the shear wall assembly, the plurality of first connecting plates are connected with the left group of slotted wall plates and the right group of slotted wall plates in the overlap manner by a first plurality of high-strength bolts; and step 4: assembling the angle steel respectively on a front side and a back side of a junction between the shear wall assembly and an upper H-shaped steel beam of the H-shaped steel beams, assembling the angle steel respectively on a front side and a back side of a junction between the shear wall assembly and a lower H-shaped steel beam of the H-shaped steel beams, and connecting the shear wall assembly with the H-shaped steel beams through a second plurality of high-strength bolts.

10. The fabricated self-resilient energy-dissipation double-steel-plate slotted shear wall structure according to claim 9, wherein, the left group of slotted wall plates or the right group of slotted wall plates of the shear wall assembly comprises at least two slotted wall plates.

11. The fabricated self-resilient energy-dissipation double-steel-plate slotted shear wall structure according to claim 9, wherein, each of the left group of slotted wall plates and the right group of slotted wall plates comprises a plurality of S-shaped streamline slots.

12. The fabricated self-resilient energy-dissipation double-steel-plate slotted shear wall structure according to claim 11, wherein, both ends of each of the plurality of S-shaped streamline slots respectively comprise a circular arc transition to reduce a stress concentration.

13. The fabricated self-resilient energy-dissipation double-steel-plate slotted shear wall structure according to claim 9, wherein, a number of the plurality of first connecting plates is two, and the two first connecting plates are symmetrically arranged on a front side and a back side of the shear wall assembly.

14. The fabricated self-resilient energy-dissipation double-steel-plate slotted shear wall structure according to claim 9, wherein, each of the H-shaped steel beams is connected with the shear wall assembly through two pieces of the angle steel, wherein the two pieces of the angle steel are symmetrically arranged on a front side and a back side of the shear wall assembly.

15. The fabricated self-resilient energy-dissipation double-steel-plate slotted shear wall structure according to claim 9, wherein, the left group of slotted wall plates and the right group of slotted wall plates are connected with the plurality of first connecting plates through a third plurality of high-strength bolts, the outer ring plate is connected with the second connecting plate through a fourth plurality of high-strength bolts, the inner ring plate is connected with the third connecting plate through a fifth plurality of high-strength bolts, the short side plate is connected with the fourth connecting plate through a sixth plurality of high-strength bolts, the shear wall assembly is connected with the angle steel through a seventh plurality of high-strength bolts, and the flanges of the H-shaped steel beams are connected with the angle steel through an eighth plurality of high-strength bolts.

16. The fabricated self-resilient energy-dissipation double-steel-plate slotted shear wall structure according to claim 15, wherein, each high-strength bolt of the first plurality of high-strength bolts, the second plurality of high-strength bolts, the third plurality of high-strength bolts, the fourth plurality of high-strength bolts, the fifth plurality of high-strength bolts and the sixth plurality of high-strength bolts is configured to withstand a high pressure, and the each high-strength bolt has a strength grade of 10.9 and a specification of M16-M30.

* * * * *